US009212880B2

(12) United States Patent
Rossi

(10) Patent No.: US 9,212,880 B2
(45) Date of Patent: Dec. 15, 2015

(54) SYSTEM FOR STEERING A FLYING OBJECT USING PAIRS OF LATERAL NOZZLES

(71) Applicant: MBDA FRANCE, Paris (FR)

(72) Inventor: Rinaldo Rossi, Paris (FR)

(73) Assignee: MBDA France, Paris (FR)

( * ) Notice: Subject to any disclaimer, the term of this patent is extended or adjusted under 35 U.S.C. 154(b) by 12 days.

(21) Appl. No.: 14/346,010

(22) PCT Filed: Sep. 20, 2012

(86) PCT No.: PCT/FR2012/000372
§ 371 (c)(1),
(2) Date: Mar. 20, 2014

(87) PCT Pub. No.: WO2013/041784
PCT Pub. Date: Mar. 28, 2013

(65) Prior Publication Data

US 2014/0224923 A1 Aug. 14, 2014

(30) Foreign Application Priority Data

Sep. 21, 2011 (FR) ..... 11 02870

(51) Int. Cl.
*F42B 10/66* (2006.01)
*F42B 15/01* (2006.01)
*F42B 10/00* (2006.01)

(52) U.S. Cl.
CPC ..... *F42B 15/01* (2013.01); *F42B 10/663* (2013.01)

(58) Field of Classification Search
CPC ..... F42B 10/60; F42B 10/66; F42B 10/663; F42B 15/01
USPC ..... 244/3.1, 3.15, 3.21, 3.22
See application file for complete search history.

(56) References Cited

U.S. PATENT DOCUMENTS

| | | | | |
|---|---|---|---|---|
| 4,211,378 | A * | 7/1980 | Crepin | 244/3.22 |
| 4,531,693 | A * | 7/1985 | Raynaud et al. | 244/3.22 |
| 4,537,371 | A * | 8/1985 | Lawhorn et al. | 244/3.22 |
| 5,238,204 | A * | 8/1993 | Metz | 244/3.22 |
| 5,823,469 | A | 10/1998 | Arkhangelsky et al. | |
| 2004/0245371 | A1 | 12/2004 | Fujita et al. | |

FOREIGN PATENT DOCUMENTS

| | | | | |
|---|---|---|---|---|
| EP | 0060726 | | 9/1982 | |
| FR | 2620812 | A1 * | 3/1989 | F42B 15/033 |
| FR | 2659733 | A1 * | 9/1991 | F42B 10/66 |
| FR | 2659734 | A1 * | 9/1991 | F42B 10/66 |

* cited by examiner

*Primary Examiner* — Bernarr Gregory
(74) *Attorney, Agent, or Firm* — Duane Morris LLP; J. Rodman Steele, Jr.; Gregory M. Lefkowitz

(57) ABSTRACT

System for steering a flying object using pairs of lateral nozzles—It comprises a gas generator (5) capable of being connected to lateral nozzles (7) via moveable plug devices (8), controlling the flow of gases coming from the generator through said nozzles. The lateral nozzles (7) are associated with at least one pair (P1, P2, P3, P4) such that the nozzles of the pair are aligned in a given axis (A1) and arranged opposite to each other, and, between the two aligned nozzles of the pair, a single controllable plug device (8) is provided, connected to said generator (5) and capable of controlling the flow of gases through said nozzles (7) in both directions.

7 Claims, 3 Drawing Sheets

SYSTEM FOR STEERING A FLYING OBJECT USING PAIRS OF LATERAL NOZZLES

CROSS-REFERENCE TO RELATED APPLICATIONS

This application is a §371 national stage entry of International Application No. PCT/FR2012/000372, filed Sep. 20, 2012, which claims priority to French Patent Application No. 1102870 filed Sep. 21, 2011, the entire contents of which are incorporated herein by reference.

The present invention relates to a system for guiding a flying machine, such as a missile or the like, using lateral gaseous jets.

BACKGROUND OF THE INVENTION

As is known, in order to guide a missile along a trajectory, in particular if said missile has to be subjected to significant and sudden load factors, use is made of guidance systems having lateral nozzles which are provided on board the missile and can be supplied with gas from either a gas generator of the main rocket motor or a gas generator specially provided for this purpose.

Thus, this results in lateral gas jets which generate transverse propulsive forces capable of quickly and significantly altering the trajectory of the missile. It can be ensured that the lines of action of such transverse forces pass through the centre of gravity of the missile, or at least in the vicinity of this centre of gravity, and in this instance the missile is said to be direct-thrust-controlled, since the time taken to respond to the control is then particularly quick. However, this is not mandatory and the lines of action of said transverse forces may pass the axis of the missile at points other than the centre of gravity. Similarly to conventional aerodynamic motivators, said transverse forces, then, create torques allowing the missile to be attitude-controlled relative to the centre of gravity.

To alter the cross section of flow for the gases flowing through the lateral nozzles and thereby act on the trajectory of the missile, guidance systems also comprise movable obturating devices which are provided between the generator and the nozzles, and control the flow of the gases from the generator.

In known embodiments, with each nozzle there is associated an obturating device comprising an obturator connected to the nozzle, and a driver which controls the movement of the obturator so as to alter the cross section of flow for the gases flowing through the neck of the nozzle. Thus, depending on their position, these devices supply thrust in a given orientation (depending on the geometric axis of the nozzle concerned) and in a single sense (dictated by the nozzle outlet).

By way of reminder, obturating devices are mainly:

- of the on/off type, using pulse width modulation (PWM) with pneumatic power actuation to modulate thrust. The pressure in the chamber(s) of a pneumatic cylinder is altered by means of valves controlled by on/off electromagnets (from 0 to maximum thrust in as little time as possible, limited by the dynamics of the electromagnets and of the actuating cylinder of the obturator). However, this simple operating principle in fact induces violent shocks (of several dozen g) and vibrations in the structures and equipment of the machine to be guided and additionally prevents precise thrust control; or
- of the electromechanical type, using electric motors associated with a reduction gear and/or a device for converting helical movement to control the position of the obturating device. Given the stresses and pressures at play, this type of device with rectilinear "needle-like" movement does not allow high dynamic performances to be achieved with a reasonable mass and spatial requirement compared with the preceding pneumatic devices.

These devices have drawbacks. The fact that they are each associated with a nozzle implies complex production and bulkiness. Operationally speaking, the rectilinear movement of an obturator to more or less close the neck of a nozzle does indeed act in a given orientation (yaw or pitch for example), but does so in the sense dictated by the nozzle. These devices also have the drawback of generating very large stresses for manoeuvring the obturator. Any balancing-out of the stresses to reduce the necessary power is complex, as is the adjustment and motorisation of a differential system. In addition, with an electromechanical solution, the rotation of the engine has to be converted into a rectilinear movement in an environment which is highly unfavourable to hot gases.

Moreover, FR 2 659 734 discloses a system for guiding a missile using lateral gaseous jets of which the device for obturating the nozzles, of which there are four that are diametrically opposed two by two, thus comprises four rotating valves having obturators which distribute the gas flow from a solid rocket motor into the four nozzles.

An adjustable thrust can thus be achieved in two perpendicular orientations. The valves are mechanically coupled two by two to ensure a constant flow rate in each pair of diametrically opposed nozzles (danger of the solid rocket motor exploding due to overpressure) and the obturators are actuated by the pistons of pneumatic cylinders which are powered by drawing gases from the rocket motor and are position-slaved. The slaving of the position of the obturators by hot-gas pneumatic cylinders allows excellent dynamic performances to be achieved on account of their very large power-to-weight ratio.

Although successfully operational, this system is nevertheless heavy, relatively complex and fiddly to adjust, particularly on account of the need to mechanically connect two by two the obturating devices, which in this case are the obturators of the valves that are each connected to two diametrically opposed nozzles so as to act in the two senses of a single orientation. It is also necessary to use refractory materials subjected to high pressures. In addition, upon ignition of the solid rocket motor, there is unavoidably a transitory moment of uncontrolled slaving due to the increase in pressure and to the random position of the various components of the device (obturator, control ball). By allowing coupling of the obturators of the valves, the mechanical connection is furthermore a source of considerable friction, which impairs the quality of the slaving and means that the power of the actuating cylinders has to be over-dimensioned.

WO 96/13694 also discloses a system for launching and orienting flying machines, which system is provided with pairs of opposed nozzles that can be controlled by obturating devices and are located in the rear portion of the flying machine to put the same, after its launch from the ground, on the trajectory, heading towards the target.

BRIEF SUMMARY OF THE INVENTION

The object of the present invention is to remedy the above drawbacks. It relates to a system for guiding a flying machine using lateral jets of compact and modular design, and is simplified so as, in particular, to achieve slaving of a thrust level in the two senses of a given orientation.

Therefore, the system for guiding a flying machine, such as a missile or the like, using lateral gaseous jets, comprises a gas generator capable of being connected to lateral nozzles by means of movable obturating devices, which control the flow of the gases from the generator through said nozzles, said nozzles being associated in pairs such that the nozzles of each pair are aligned along the same axis and arranged in opposition to each other, there being, between the two aligned nozzles of the pair, a single controllable obturating device which is connected to said generator and capable of controlling the flow of the gases through said nozzles in the two senses, the system being distinctive in that the nozzle pairs are contained in a plane that is perpendicular to the machine axis which passes through the centre of gravity thereof.

Thus, owing to the invention, a single obturating device controls two nozzles and makes it possible to act in the two senses of a single orientation dictated by the pair of opposed and aligned nozzles, in such a way as to achieve slaving of a level of thrust in the two senses in the orientation of the nozzle pair, and to constantly modulate the thrust in this common orientation.

The system therefore overcomes the earlier drawbacks by imposing one obturating device per nozzle, which acts solely in the sense of the nozzle concerned, and allows the mechanical connections between the valves to be dispensed with, thereby simplifying production of the system.

For example, two nozzle pairs are arranged diametrically opposed to each other in a plane that is perpendicular to the longitudinal axis of the machine. Thus, the machine can be guided along either the roll and yaw axes or the roll and pitch axes. The nozzle pairs can be operated independently from each another or at the same time as the obturating devices of the two pairs in the same position or in different positions so that the machine assumes the most appropriate trajectory at each moment of the flight by combining various movements if necessary.

In another preferred example, four nozzle pairs are arranged so as to be uniformly distributed relative to one another in a plane that is perpendicular to the machine axis, the four pairs being diametrically opposed two by two. Direct thrust control of the machine is possible along the roll, yaw and pitch axes with operation as indicated above. Whatever the examples, the machine is guided as far as the target all the way along the trajectory, which may vary.

Preferably, the guidance system comprises two sets of pairs of aligned and opposed nozzles, said sets being provided in planes which are mutually parallel and are perpendicular to the longitudinal axis of the machine, one of said planes passing through the centre of gravity of said machine. Thus, with such an arrangement, the machine can be direct-thrust-controlled by imparting thereon transverse forces by means of the set of nozzle pairs passing through the centre of gravity, or the machine can be attitude-controlled along the roll, pitch and yaw axes, by means of the other set.

More particularly, the nozzle pairs, with each of which a single obturating device is associated, are located at the periphery of the external cylindrical body of the machine and surround the gas generator while in fluid communication therewith.

In a preferred embodiment, each obturating device is of the type having a rotating obturator for altering the cross sections of flow for the gases from the generator through the nozzles, doing so in the reverse manner from one another.

For example, each obturating device comprises a body having an internal passage in which the rotating obturator is received and which has two diametrically opposed openings which are each joined to one of the necks of the aligned and opposed nozzles, and an opening which is joined to the gas generator.

Each obturator can occupy a neutral position for which the openings are in mutual communication, allowing the gases—when the generator is a propellant charge also ensuring the axial thrust of the machine—to flow at all times at a constant flow rate through the nozzle pairs, avoiding the dangers of overpressure. Where the generator uses liquid propellants, the obturators then occupy a neutral position for which they close the openings joined to the generator.

Moreover, each obturating device additionally comprises a controllable driver which receives the proportional operating commands and is connected to the obturator so as to move the same and to continuously alter the cross sections of flow for the gases flowing through the nozzles. Said driver is preferably a torque motor which is connected parallel to or coaxially with a rotating shaft bearing said obturator by means of a connection mechanism.

BRIEF DESCRIPTION OF THE DRAWINGS

The figures of the accompanying drawings will illustrate how the invention can be carried out. In these figures, identical references denote like elements.

DETAILED DESCRIPTION OF THE INVENTION

Figure 1:
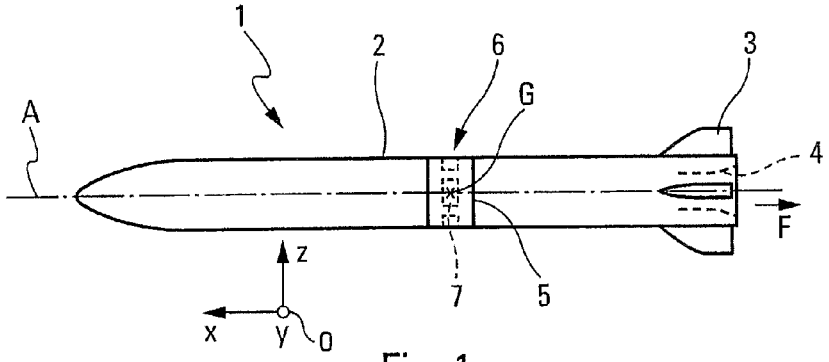
FIG. 1 is a schematic view of a flying machine, such as a missile, having a guidance system according to the invention.

The flying machine such as the missile 1, shown schematically in FIG. 1, comprises an elongated cylindrical body 2 of longitudinal axis A which ends, at the rear, in tail fins 3 of which there are four, for example, which are diametrically opposed two by two, and perhaps equipped with motivators (not shown). The gaseous jet, which exits an axial nozzle 4 (shown in a dashed line), is symbolised by an arrow F and comes, as is customary, from a gas generator 5 that is inside the body 2 of the missile and imparts thrust to the missile 1.

Figure 2:
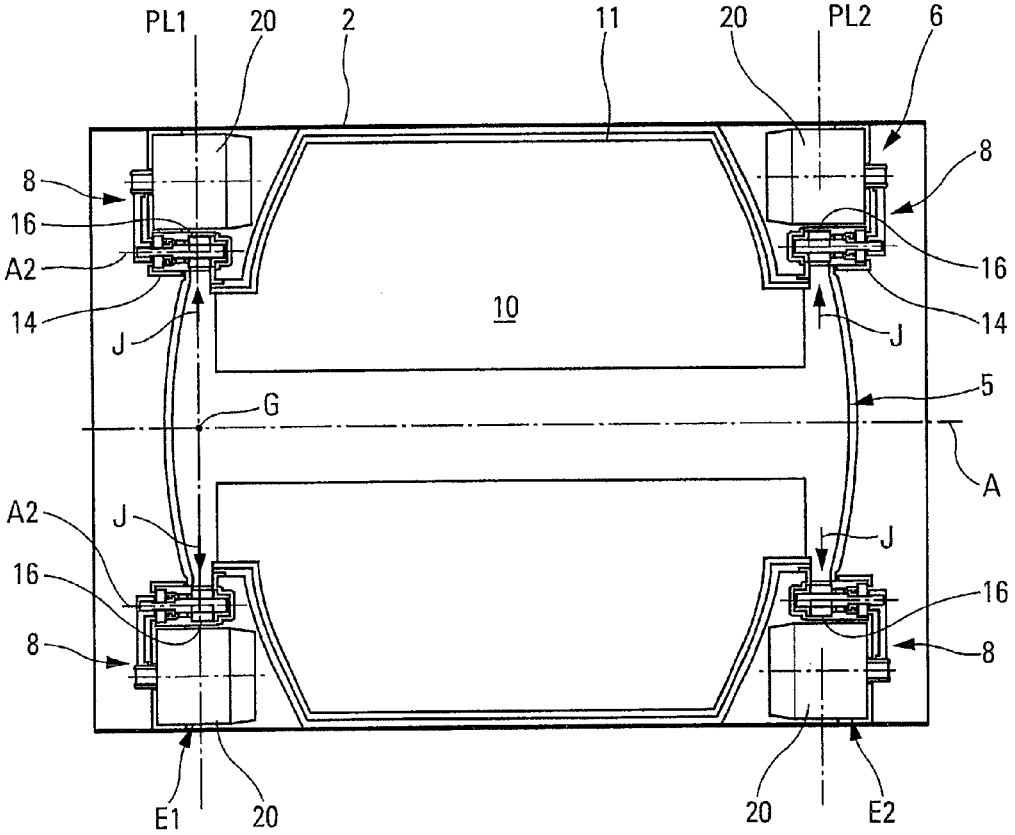
FIG. 2 shows an embodiment of the guidance system comprising, in this case, two sets of lateral nozzles having associated obturating devices.
Figure 3:
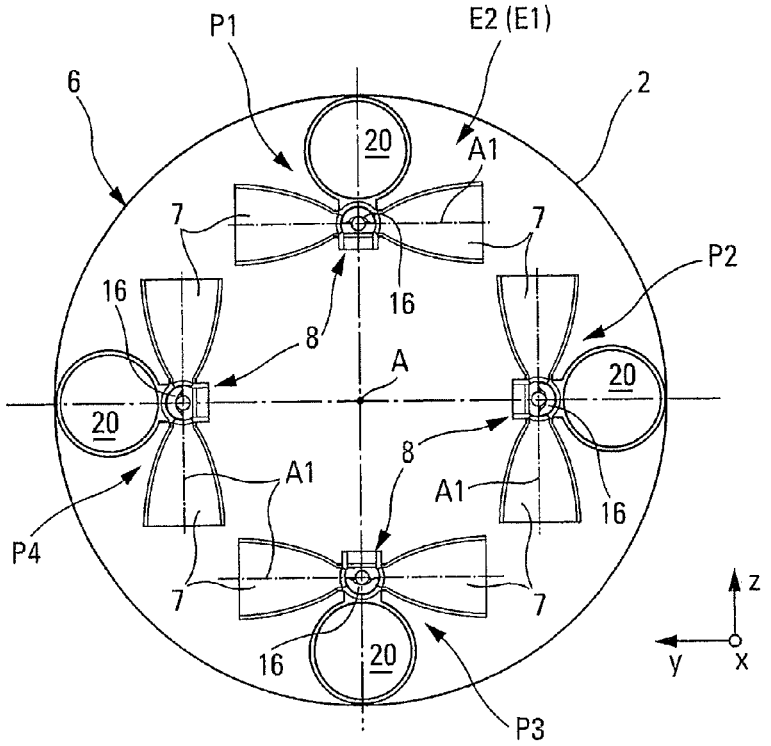
FIG. 3 is a transverse view of one of the sets of lateral nozzles which shows the arrangement thereof.

In the vicinity of the centre of gravity G of the missile 1 there is provided, in the cylindrical body 2, a guidance system 6 which, as shown in FIGS. 1 to 3, is composed of lateral nozzles 7, controllable obturating devices 8 and a gas generator. In this example, the generator is the gas generator 5 that provides axial thrust to the missile; however, it goes without saying that the generator of the system could be different from the main generator. The thus arranged guidance system 6 allows, as will be seen hereinafter, the attitude of the missile 1 to be acted upon along the roll, yaw and pitch axes (see the Oxyz reference system, FIG. 1), and forces to be applied along y and z passing through the centre of gravity G. It is thus a system of the direct-thrust-control type.

The gas generator 5 of the system 6 and of the missile 1 consists, as shown by FIG. 2, of a solid propellant charge 10 housed in a cylindrical housing or container 11 which is mounted, in the customary manner, inside the cylindrical body of the missile.

In this non-limiting embodiment, the system 6 comprises two sets E1, E2 of lateral nozzles 7, the sets having the same number of nozzles and being arranged in two parallel planes PL1 and PL2, which are perpendicular to the longitudinal axis A of the missile (x axis of the reference system).

The guidance system 6 of the invention consists in associating in pairs lateral nozzles 7 that are in opposition to each other, such that the two nozzles of each pair are controllable from the same obturating device 8 provided therebetween. For this purpose, the two lateral nozzles 7 of each pair are aligned along the same axis A1 (FIGS. 3 and 4) and arranged in opposition to each other with the necks 12 of these nozzles facing each other and being fixed to the common obturating device 8 at the centre of the two nozzles.

As can be seen in FIGS. 2 and 3, each set E1, E2 comprises, in this example, four identical pairs P1, P2, P3, P4 of two lateral and opposed nozzles 7, the four pairs being diametrically opposed two by two and located close to the periphery of the cylindrical body 2 of the missile 1. Thus, in this example, two pairs are located parallel to the y axis of the reference system and two other pairs are parallel to the z axis. The two sets E1 and E2 thus comprise sixteen nozzles 7 forming eight double nozzles or nozzle pairs.

Moreover, in this example again, the plane PL1 of the first set E1 of four pairs of opposed lateral nozzles passes at least substantially through the centre of gravity G of the missile 1, thereby ensuring direct-thrust-control thereof. As regards the plane PL2 of the second set E2, this is offset in parallel from the plane PL1 and the lateral nozzle pairs ensure, in particular, attitude-control of the missile.

Of course, the sets E1, E2 can be operated independently from each other or simultaneously, with the actuation, through the control of the relevant obturating devices 8, of one or more of whichever pairs P1, P2, P3, P4 of lateral nozzles 7. The guidance system 6 is also not limited to this specific arrangement of two planes each of four pairs of opposed nozzles. At least one pair of opposed lateral nozzles 7, which is controllable by a common obturating device 8 and contained in a plane that is perpendicular to the longitudinal axis of the missile, is sufficient to guide the missile in the two senses of one and the same orientation dictated by the common alignment axis A1 of the opposed nozzles. Of course, it is preferable to have at least two nozzle pairs arranged symmetrically about the axis of the missile so as to avoid the parasitic effects that would occur with just one pair.

Figure 4:
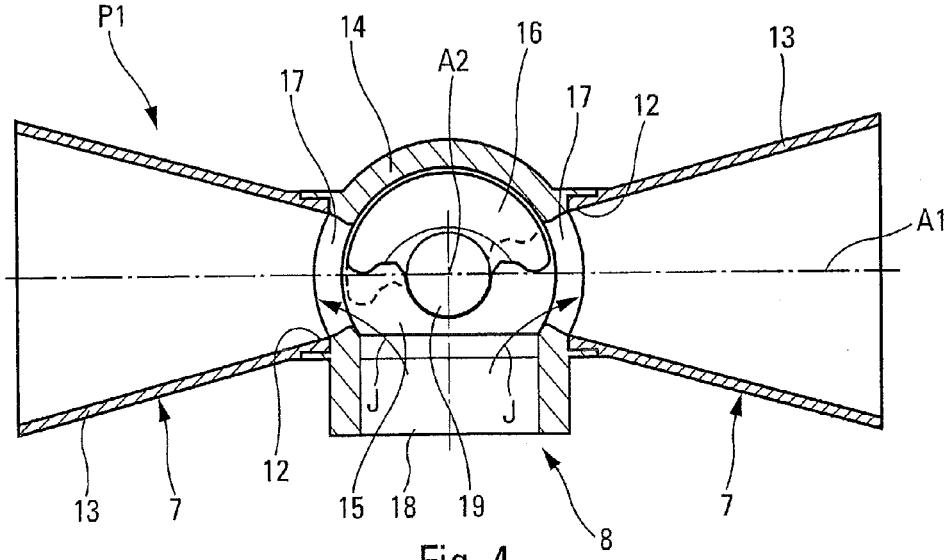
FIG. 4 shows the obturator of an obturating device guiding the pair of associated lateral nozzles, which are aligned in opposition.

As can be seen in particular with reference to FIG. 4, the lateral walls 13 delimiting the two lateral nozzles 7, which are aligned in opposition, of the pair denoted P1 are directly attached to a body 14 of the controllable obturating device 8, which is common to the two nozzles, by any appropriate means (screwing, welding, etc.). An axial passage 15 is provided in the body 14 and houses the obturator 16 itself, which is of the rotating type, rotating about an axis A2 that is parallel to the axis A of the missile and, therefore, perpendicular to the common axis A1 of the aligned nozzles.

This internal passage 15 has a cylindrical shape for rotation of the obturator and acts as an intermediate chamber between the generator 5 and the two lateral nozzles 7, having the obturator 16 with which, depending on its position and in a reverse manner from one another, it is possible to adjust the cross section of flow for the gases from the generator 5 through the necks 12 of the nozzles, at a constant flow rate in the case of a propellant generator, and then to act on the trajectory of the missile.

For this purpose, to ensure fluid communication between the internal passage or chamber 15 of the body 14 and the necks 12 of the nozzles 7, which nozzles are aligned in opposition, two openings 17 are made, in a diametrically opposed manner, in the body and, once the nozzles have been rigidly connected to the body, each open out towards one of the necks of said nozzles.

And, to ensure fluid communication between the internal passage 15 of the body of the device 8 and the propellant charge 10 of the gas generator 5, a radial opening 18 is provided in the body, perpendicularly, on the one hand, to the common axis A1 of the nozzles 7 and, on the other hand, to the axis of rotation A2 of the obturator, that is of the axial passage 15 of the body 14.

In particular, the shown obturator 16 has an appropriate shape to allow the free flow of the gases from the generator 5 when the propellant charge 10 is initiated, and to alter the cross section of flow for the gases through the openings 17 and towards the neck of the opposed nozzles 7 of the relevant pair P1, as a result of the control of the obturator. Said obturator thus allows for thrust modulation by means of the position it is occupying. In this example, the obturator 16 covers approximately 180° of the internal passage 15 and is in the shape of an angular half-crown-shaped (or bean-shaped) segment provided on a shaft 19 that rotates about the axis A2. The obturator 16 and the shaft 19 are, preferably, formed in one and the same piece.

Thus, in the position shown in FIG. 4, which position has been described as neutral, for which no guidance command is sent towards this pair P1 of opposed lateral nozzles 7, the obturator 16 obstructs half of the two diametral openings 17 in the body 14 that lead into the necks 12 of the nozzles (where the generator uses liquid propellant, the angular cross section of the obturator will be in the region of 240° to simultaneously close the necks of the two nozzles). Operation of the system 6 and of its devices 8 will be described hereinafter.

Figure 5:
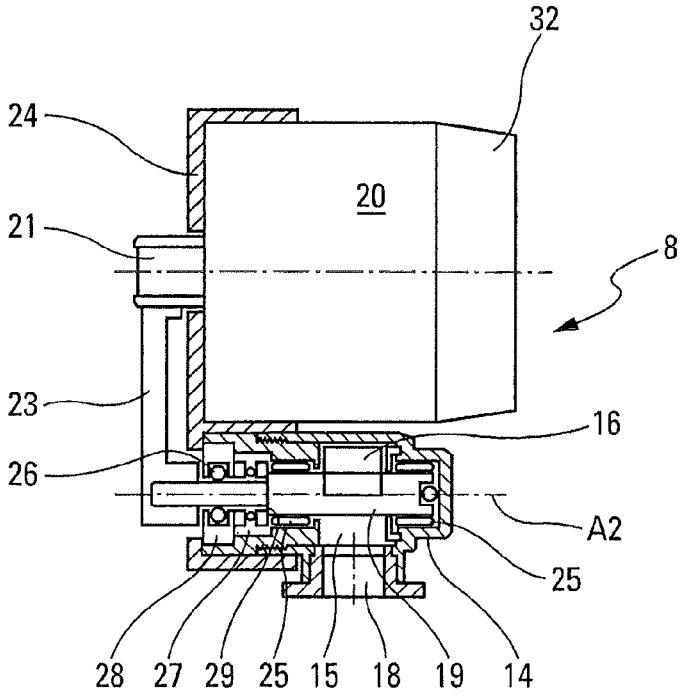
FIGS. 5 and 6 show an obturating device with two examples for mounting the driver controlling the obturator.
Figure 6:
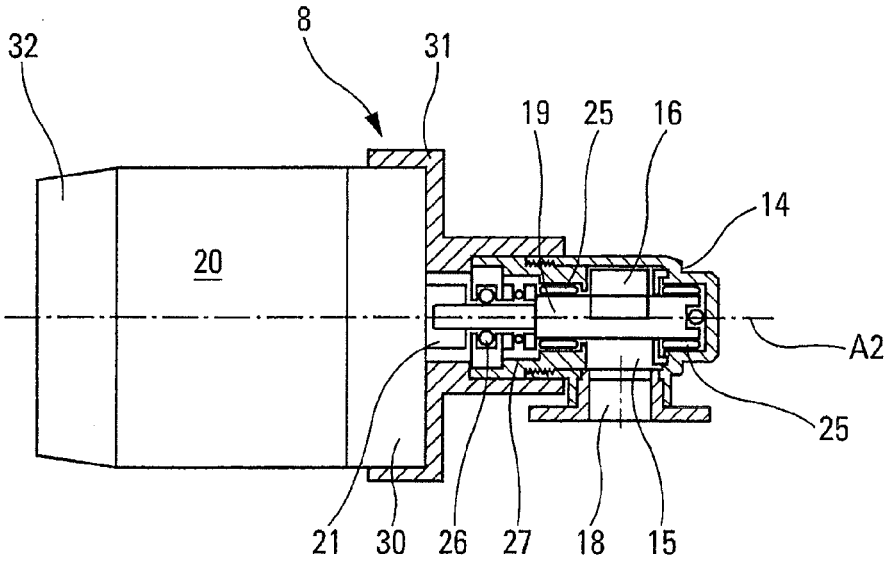

Rotational control of the shaft 19 of the obturator of the relevant device 8 is achieved by means of a driver 20 that is arranged, in the two embodiments shown in FIGS. 5 and 6 respectively, either parallel to the axis of rotation A2 of the shaft 19 (FIG. 5) or coaxially with the axis A2 thereof (FIG. 6).

In the embodiment shown in FIGS. 2 and 5 in particular, the driver 20 of each obturating device 8 common to the relevant nozzle pair P1, P2, P3, P4 is offset in parallel from the obturator 16. To ensure transmission of movement, the output shaft 21 of the driver and the shaft 19 of the obturator are interconnected by a connection mechanism, such as a toothed segment 23, which forms a reduction stage between the pinion of the output shaft 21 and the shaft 19 of the body 14. A common case 24 moreover joins the driver 20 to the body 14 of the device.

In addition, to minimise frictional torque, the shaft 19 of the obturator is mounted on needle bearings 25 provided between the body 14 of the device and the shaft 19, on either side of the obturator 16. A toric seal ring 26 is additionally provided between the body and the shaft and protects the inside of the obturating device 8 from the external environment (thermal flux). And a ball thrust 27 is also arranged between the support 28 of the ring and a shoulder is provided on the shaft 19 of the obturator.

In another embodiment shown in FIG. 6, the driver 20 is coaxial with the obturating device 8. For this reason, a planetary gear unit 30 or any other appropriate reduction mechanism is directly connected at the output of the driver and connected, via its shaft 21, to the shaft 19 of the obturator. A cylindrical case 31 also associates the reduction gear 30 to the body 14 of the device. Here too, the rotating shaft 19 is mounted, relative to the fixed body 14, on needle bearings 25 and by means of an axial ball thrust 27. The seal ring 26 is also provided.

The reduction relationship, however, has to remain sufficiently weak for the device to maintain high dynamics (speed and acceleration) that are compatible with guidance of the missile.

Whatever embodiment is adopted, the driver 20, owing in particular to the mounting of bearings and a ball thrust, may be a simple electrical torque motor of compact size, which provides sufficient torque to drive the obturator. Advantageously, a housing 32 is associated with this torque motor, at the rear thereof, and contains appropriate power and slaving electronics (not shown) for operating each obturating device 8 to be controlled. The driver is position-slaved and integrates an angular position sensor or any other appropriate device. Precise knowledge of the position of each obturator obtained by the feedback sensor and of a measure of the pressure of the propellant gases allows the level of thrust (amplitude and sign) to be determined, in a relatively precise manner, according to the controlled position of the obturator.

Of further note is the particularly simple design of the common obturating device 8 from the perspective of both its structure (assembly) and operation (adjustment and value of the angle of the angular segment of the obturator required to open and close the associated nozzles).

Although it is preferable to use a rotating obturator, an obturator that is movable in translation would also be feasible, although this would involve more complex mounting.

Operation of the guidance system 6 fitted to such a missile 1 is as follows.

It is assumed that the missile follows the imposed trajectory, since the propellant charge 10 of the generator 5 in the process of combustion ensures the axial thrust F of the missile, without the intervention of the guidance system.

In this configuration, all the obturators 16 of the obturating devices 8 associated with the pairs P1, P2, P3, P4 of opposed nozzles 7 occupy a neutral position as shown in FIGS. 3 and 4. That is to say, the cross sections of the necks 12 of the nozzles through which the lateral gaseous jets J flow after passing the opening 18, the passage or chamber 15 and the two diametral openings 17 in each device, are the same. Thus, the jets J which, in the example described, exit the four pairs of opposed nozzles 7 of the two sets E1, E2 balance one another out and do not act on the axial trajectory of the missile.

Should we want to alter the trajectory of the missile for any reason, a command is given to act, via the actuator electronics 32, on the obturator 16 of the nozzle pair of the selected device 8 or, of course, on the actuator electronics of a plurality of obturators of the selected pairs should we want, for example, to impart on the missile movements along the roll, pitch and yaw axes (Oxyz reference system) about the centre of gravity, and/or forces in a plane yz that is perpendicular to the x axis and passes through the centre of gravity G.

In the example to which FIGS. 3, 4 and 5 or 6 relate the obturating device 8 is powered up by an appropriate source (not shown) powering the actuator electronics. The thus excited driver 20 drives, by means of the connection mechanism 23 (FIGS. 2 and 5) or 30 (FIG. 6), the angular pivoting of the shaft 19 in the selected sense and at the selected angle. In this way, the obturator 16 in the shape of an angular segment rotates about the axis A2, leaving the neutral position. A new position then adopted by the obturator is shown by way of example in a dashed line in FIG. 4, from which it can be seen that the opening 17 leading towards the nozzle on the left-hand side of this drawing is better obturated than in the initial position where this opening is half open and half closed. By contrast, simultaneously and conversely, the opening 17 leading towards the right-hand nozzle is more open.

It is thus clear that, in this new position shown in a dashed line, the cross section of flow for the gaseous jet J exiting through the right-hand nozzle is larger than the cross section of flow for the gaseous jet exiting through the left-hand nozzle.

Taking into consideration the fact that the nozzle pair of the relevant device 8 belongs to the set E2 intended to control the attitude of the missile, and corresponds to that of P1 located at the top of FIG. 3, rotation of the obturator (about approximately 20°) results in action of the gaseous jets J in the two senses along the common axis A1 at the two nozzles. This drives a roll movement of the missile about the axis A for controlling the degree of freedom in the two senses by means of a single nozzle pair. If only this degree of freedom (roll axis) is acted upon, it is preferable, so as to not disturb the other degrees of freedom (pitch and yaw axes), to act in the same manner on the nozzle pair P3 at the bottom of FIG. 3 by rotating the obturator of the corresponding device. In this way, symmetry of action of the two pairs P1, P3 of nozzles 7 is achieved, as is, therefore, pure torque for carrying out the roll.

Where the nozzle pair P1 belongs to the set E1 intended for direct thrust control through the implementation of the device 8 having driven the leftward rotation of the obturator, a rightward force is generated, along the y axis, which moves the missile in translation from this side.

Returning to the nozzle pairs of the set E2, the obturators can just as well be acted upon in the same manner as differently.

For example, still considering the two pairs P1, P3 of opposed nozzles 7 at the top and bottom of FIG. 3, two degrees of freedom are controlled herewith, namely roll and yaw. If the obturators of the two devices 8 are rotated in the same direction with identical rotation, a leftward or rightward force is generated that is perpendicular to the plane xz formed by the roll axis x and the yaw axis z, whereas, if they are rotated in opposite directions, a roll torque is generated about the axis A (x axis of the reference system).

It is also possible to combine the action of the two nozzle pairs above by rotating the obturator 16 of the pair P1 leftward by, for example, 20° to create the roll and the obturator 16 of the pair P3 rightward by 10° to create the yaw. Of course, this is done within the limits of the guidance of the missile.

Such operation is also achieved by the two pairs P2, P4 of nozzles 7, located on the left-hand and right-hand sides of FIG. 3, where it is possible to control two degrees of freedom, namely roll and pitch. If the obturators 16 of the two pairs P2, P4 are rotated in the same direction with identical rotation, an upward or downward force is generated that is perpendicular to the plane xy formed by the roll axis x and pitch axis y, whereas, if they are rotated in opposite directions, a roll torque is generated about the axis A (x axis).

Of course, any combination of the four nozzle pairs according to the direction of rotation of the obturators and the given angle is possible for modulating the cross sections of flow for the gaseous jets in the nozzles and for thereby achieving the desired trajectory to be taken by the missile. This is just as true for the set E1 as the set E2.

Such an arrangement with two sets of four pairs implies a degree of repetition between the nozzle pairs in the movements about the axes. Although not obligatory, it would be feasible, without departing from the scope of the invention, to have an arrangement with three nozzle pairs, uniformly distributed at 120° from one another about the axis A of the body.

The guidance system 6 according to the invention allows the missile to be guided along its trajectory as far as the target by acting on the three degrees of freedom by attitude-control about the xyz axes of the reference system and/or by exerting stresses thereon which pass through the centre of gravity of said missile.

The invention claimed is:

1. System for guiding a flying machine using lateral gaseous jets, comprising a gas generator (5) capable of being connected to lateral nozzles (7) by means of movable obturating devices (8), which control the flow of the gases from the generator through said nozzles, said nozzles being associated in pairs (P1, P2, P3, P4) such that the nozzles of each pair are aligned along the same axis (A1) and arranged in opposition to each other, there being, between the two aligned nozzles of the pair, a single controllable obturating device (8) which is connected to said generator (5) and capable of controlling the flow of the gases through said nozzles (7) in the two senses, wherein the pairs (P1, P2, P3, P4) of nozzles (7) are contained in a plane that is perpendicular to the machine axis which passes through the centre of gravity (G) thereof, wherein the nozzle pairs, with each of which a single obturating device (8) is associated, are located at the periphery of the external cylindrical body (2) of the machine and surround the gas generator (5) while in fluid communication therewith, and wherein each obturating device (8) additionally comprises a controllable driver (20) which receives proportional operating commands and is joined to the obturator (16) so as to move the same and to continuously alter the cross section of flow for the gases flowing through the nozzles (7).

2. System according to claim 1, wherein four pairs (P1, P2, P3, P4) of nozzles (7) are arranged so as to be uniformly distributed relative to one another, the four pairs being diametrically opposed two by two.

3. System according to claim 1, wherein two sets (E1, E2) of pairs (P1, P2, P3, P4) of aligned and opposed nozzles (7) are provided in planes (PL1, PL2) which are mutually parallel and are perpendicular to the longitudinal axis of the machine, one (PL1) of said planes passing through the centre of gravity (G) of said machine.

4. System according to claim 1, wherein each obturating device (8) is of the type having a rotating obturator (16) for altering the cross sections of flow for the gases from the generator through the nozzles, doing so in the reverse manner from one another.

5. System according to claim 4, wherein each obturating device (8) comprises a body (14) having an internal passage (15) in which the rotating obturator (16) is received and which has two diametrically opposed openings (17) which are each joined to one of the necks of the aligned and opposed nozzles (7), and an opening (18) which is joined to the gas generator (5).

6. System according to claim 1, wherein said driver (20) is a torque motor which is joined parallel to or coaxially with a rotating shaft (19) bearing said obturator by means of a connection mechanism (23, 30).

7. System according to claim 1, wherein the flying machine is a missile.

* * * * *